United States Patent [19]

Westcott et al.

[11] Patent Number: 4,582,071

[45] Date of Patent: Apr. 15, 1986

[54] TIPPING ASSEMBLY FOR AN ELONGATE SMOKING ARTICLE

[75] Inventors: David T. Westcott, Portishead; Noel Evans, Keynsham; Keith Milsom, Bristol, all of England

[73] Assignee: Imperial Group Limited, London, England

[21] Appl. No.: 326,139

[22] Filed: Nov. 30, 1981

[30] Foreign Application Priority Data

| | | | |
|---|---|---|---|
| Dec. 22, 1980 | [GB] | United Kingdom | 8041009 |
| Jul. 11, 1981 | [GB] | United Kingdom | 8121419 |
| Jul. 11, 1981 | [GB] | United Kingdom | 8121420 |

[51] Int. Cl.[4] ..... A24D 3/04

[52] U.S. Cl. ..... 131/336; 131/361

[58] Field of Search ..... 131/336, 362, 361, 363, 131/339

[56] References Cited

U.S. PATENT DOCUMENTS

| | | | |
|---|---|---|---|
| 3,359,988 | 12/1967 | Thomson | 131/336 |
| 3,390,684 | 7/1968 | Hudnell | 131/336 |
| 3,396,733 | 8/1968 | Allseits et al. | 131/336 |
| 3,469,584 | 9/1969 | Doppelt | 131/336 |
| 3,490,461 | 1/1970 | Osmalov et al. | 131/336 |
| 3,606,892 | 9/1971 | Wilson | 131/336 |
| 3,773,053 | 11/1973 | Stephens, Jr. | 131/336 |
| 3,788,330 | 1/1974 | Griffith | 131/339 |
| 4,256,122 | 3/1981 | Johnson | 131/336 |
| 4,338,956 | 7/1982 | Sanford et al. | 131/336 |
| 4,362,172 | 12/1982 | Johnson | 131/336 |

FOREIGN PATENT DOCUMENTS

| | | | |
|---|---|---|---|
| 2849904 | 5/1979 | Fed. Rep. of Germany | 131/336 |
| 864247 | 3/1961 | United Kingdom | 131/336 |

*Primary Examiner*—V. Millin
*Assistant Examiner*—H. Macey
*Attorney, Agent, or Firm*—Larson and Taylor

[57] ABSTRACT

A cigarette is provided with a cylindrical ungrooved filter plug which is surrounded by a ventilated tipping wrapper spaced radially from the plug by a slotted sheet laminated to the inner surface of the tipping wrapper. The slots communicate with the ventilated portions of the tipping wrapper and provide channels extending to the mouth end of the plug, whereby ventilating air is drawn into the smoker's mouth unmixed with smoke passing through the filter plug.

7 Claims, 29 Drawing Figures

TIPPING ASSEMBLY FOR AN ELONGATE SMOKING ARTICLE

Figure 1:
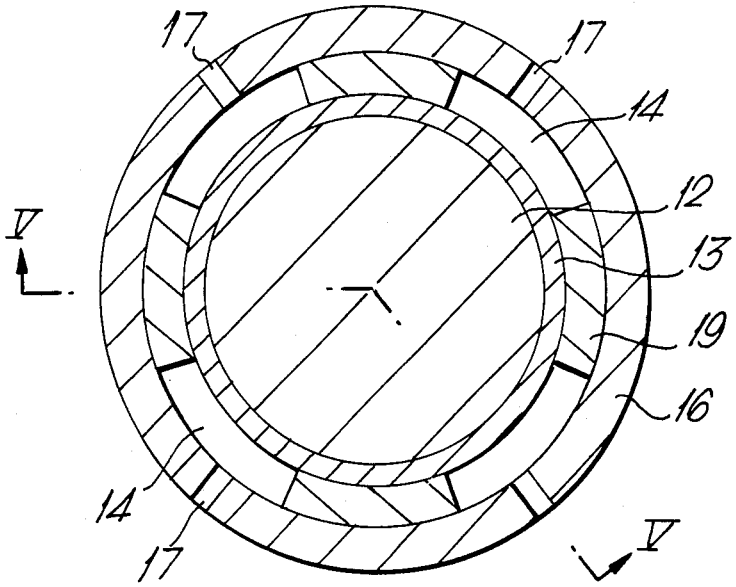

This invention relates to a tipping assembly for an elongate smoking article such as a cigarette.

One aspect of the invention concerns a tipping assembly having ventilation means and further means whereby the ventilation characteristics may be controlled.

A second aspect concerns a rod of smokeable material in combination with a tipping assembly according to the first aspect.

It is well known to provide ventilation in filters for cigarettes. Such ventilation provides that smoke entering the smoker's mouth from the burning tobacco is diluted by air drawn into the filter from the surrounding atmosphere. This dilution brings about a reduction in particulate material and gas phase components in the smoke. Known means of providing ventilation in cigarettes include a porous or perforated wrapper round the tobacco, a perforated or porous filter tipping wrapper, grooves in the surface of the filter plug, or a corrugated porous plug wrap (as shown for instance in U.S. Pat. No. 3,596,663).

It is an advantage of the present invention that it provides a tipping assembly which, in combination with a filter plug, can readily be modified to vary the ventilation characteristics and to bring ventilating air to a smoker's mouth by a variety of routes as desired, depending on the grade and quality of tobacco or other smoking material used, without the necessity of redesigning or altering the filter plug itself. It is a further advantage of the present invention that means are provided whereby the smoke delivery can readily be varied to provide a wide variety of smoke flavour enhancement when ventilation is used. The present invention has the further advantage that the particulate material content of the smoke is controlled at least as much by ventilation as by filtration.

Further advantages of the invention are that it may be used to provide controlled ventilation for plugs other than traditional filter plugs, such as a plug containing tobacco, and for smoking articles such as cigarettes of the "papirossi" kind. A "papirossi" cigarette comprises a tobacco rod to which is attached a mouthpiece consisting of a hollow cardboard tube through which the smoke passes before entering the mouth of the smoker.

Other features of the present invention will become apparent to those skilled in the art from perusal of the following disclosure.

According to a first aspect of the present invention there is provided a tipping assembly for an elongate smoking article comprising:

(a) a cylindrical element having a circumferential surface of circular cross-section (b) a ventilated tipping wrapper surrounding but spaced radially from the cylindrical element (c) means spacing the tipping wrapper from the cylindrical element (d) air channels extending longitudinally to a mouth end of the assembly, the channels being at least partly defined by portions of the spacing means and the circumferential surface of the cylindrical element, the arrangement being that in use air passes through the ventilated tipping wrapper into the channels.

The channels may be further partly defined by portions of the tipping wrapper. The spacing means may be provided by a laminated tipping wrapper of which the inner lamination is adapted to define partly the air channels.

According to a second aspect of the present invention there is provided the combination of a tipping assembly according to the first aspect with a rod of smokeable material.

According to a third aspect of the present invention there is provided a laminated tipping wrapper for a tipping assembly for a smokeable article in which the inner lamination is adapted to define slots, grooves or corrugations.

Figure 2:
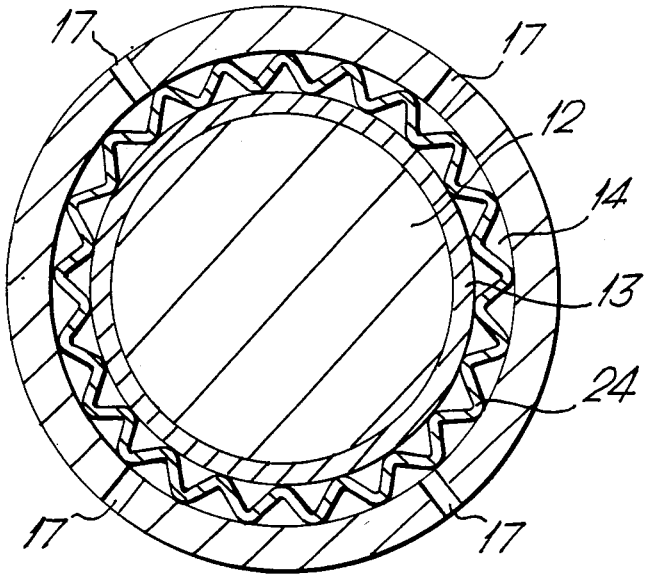
Figure 3:
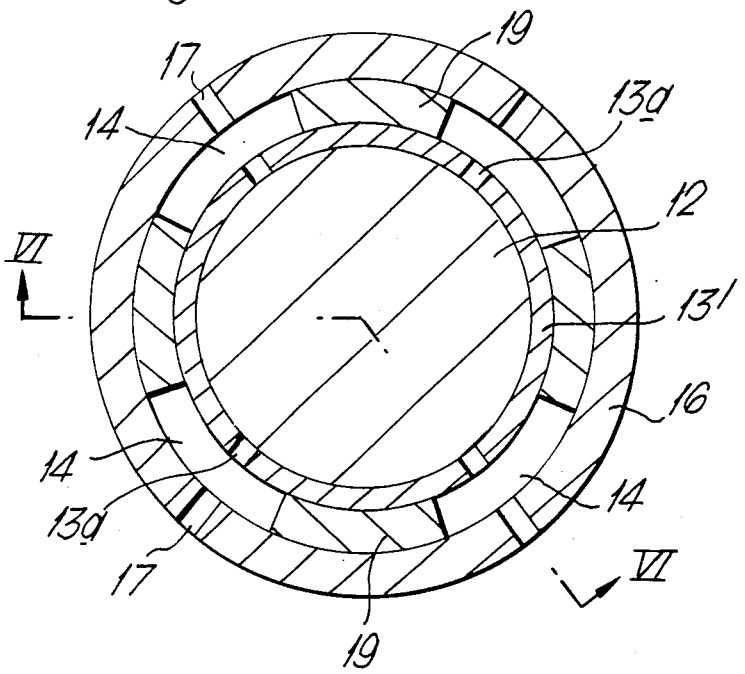
Figure 4:
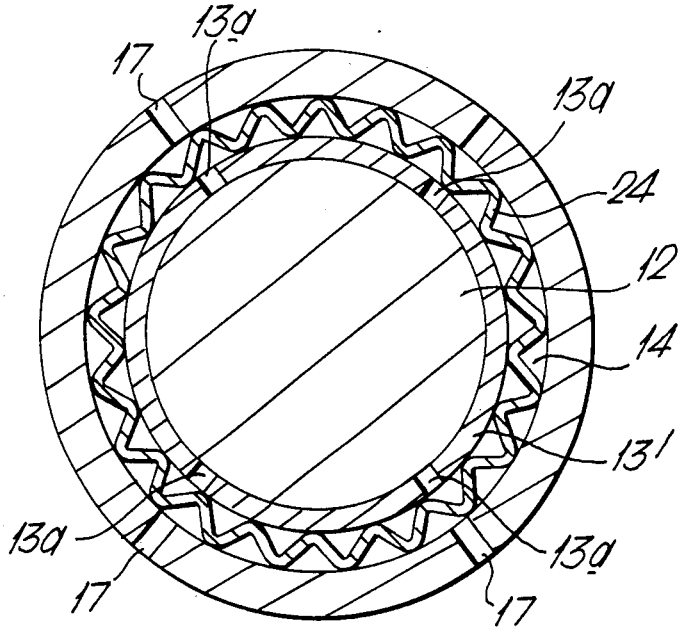
Figure 5:
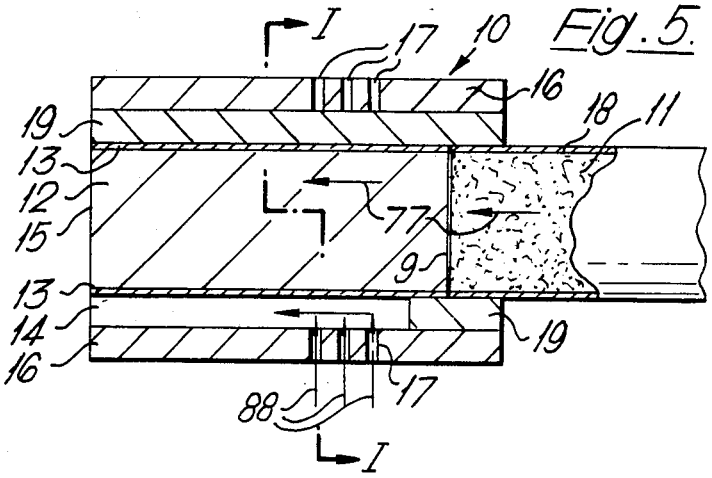
Figure 6:
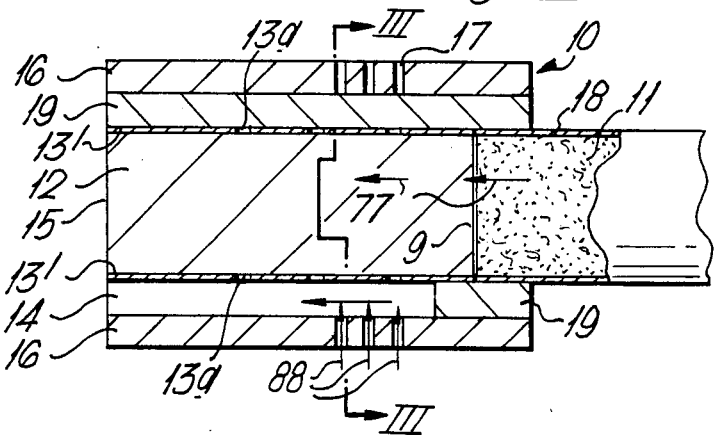
Figure 7:
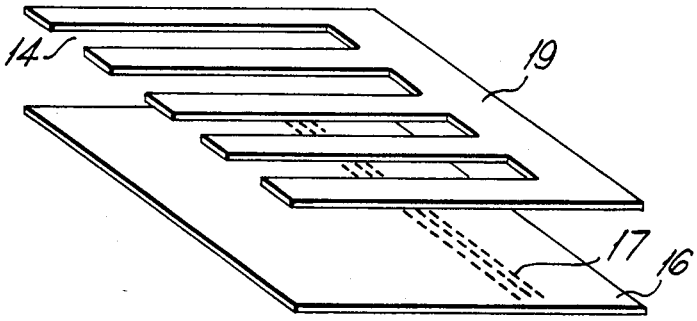
Figure 8:
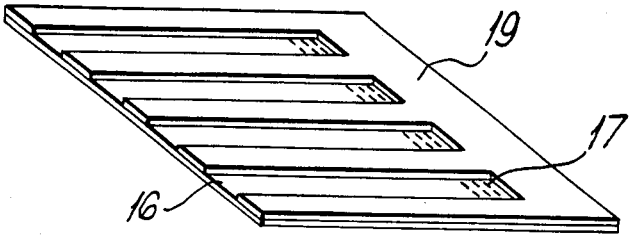
Figure 9:
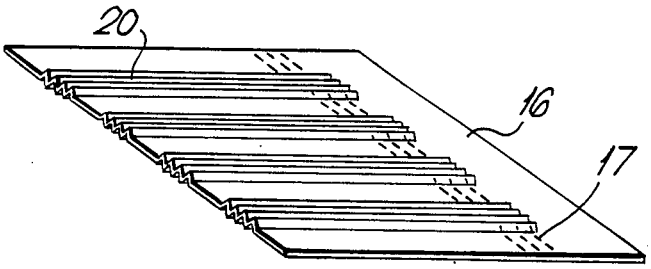
Figure 10:
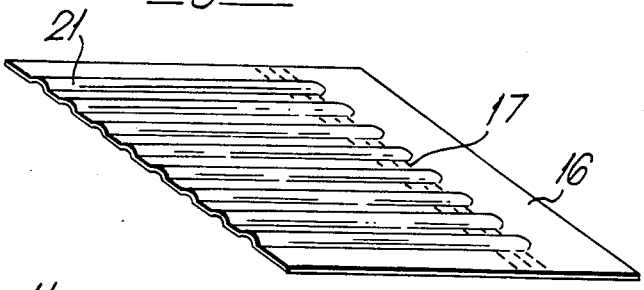
Figure 11:
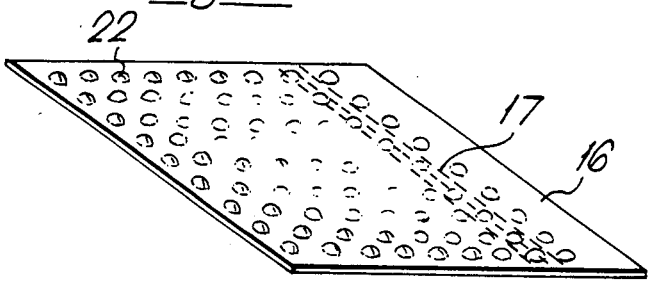
Figure 12:
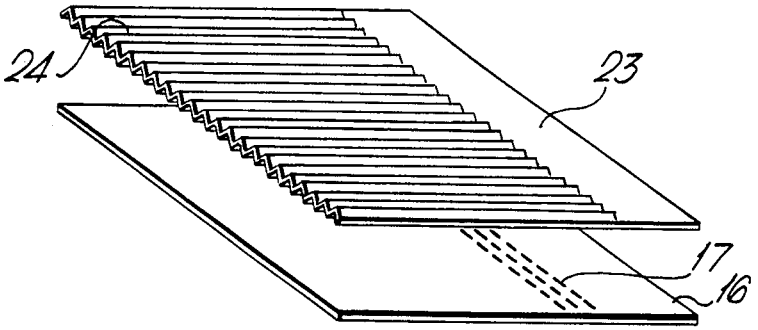
Figure 13:
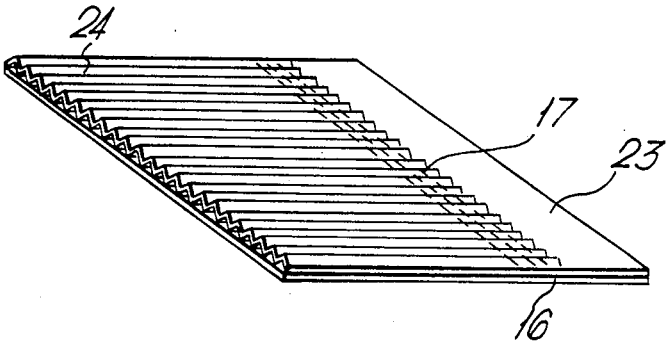

The invention will now be described by way of example only with reference to the accompanying non-scale drawings in which, FIG. 1 is a transverse cross-section through a first embodiment of a tipping assembly of the present invention taken at line I—I of FIG. 5, FIG. 2 is a transverse cross-section through a second embodiment of a tipping assembly of the present invention using the spacing means of FIGS. 12 and 13, FIG. 3 is a transverse cross-section through a third embodiment of a tipping assembly of the present invention taken at line III—III of FIG. 6, FIG. 4 is a transverse cross-section through a fourth embodiment of a tipping assembly of the present invention, FIG. 5 is a longitudinal cross-section of the tipping assembly of FIG. 1 taken at line V—V of FIG. 1, and including an attached tobacco rod, FIG. 6 is a longitudinal cross-section of the tipping assembly of FIG. 3 taken at line VI—VI of FIG. 3, and including an attached tobacco rod, FIG. 7 is a perspective view of a first embodiment of spacing means, and tipping wrapper, FIG. 8 is the view of FIG. 7 showing the tipping wrapper laminated to the spacing means, FIGS. 9–11 are perspective views of second, third and fourth respective embodiments of spacing means provided by modified tipping wrappers, FIG. 12 is a perspective view of a crimped spacing means, and a tipping wrapper.

Figure 14:
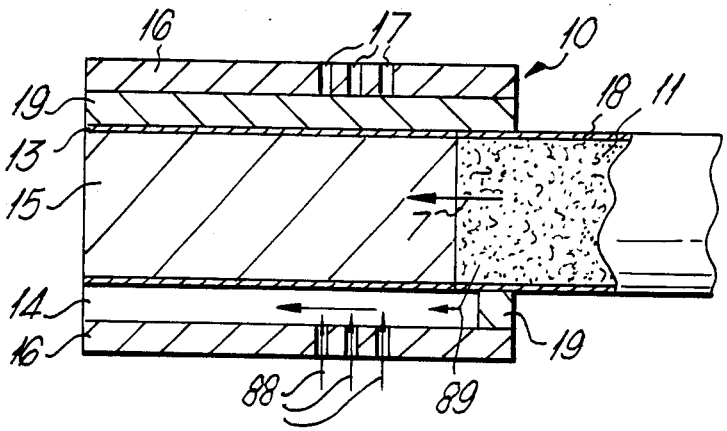
Figure 15:
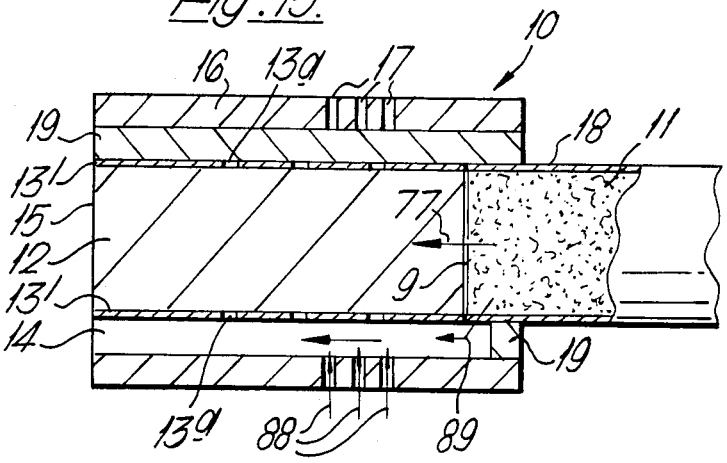
Figure 16:
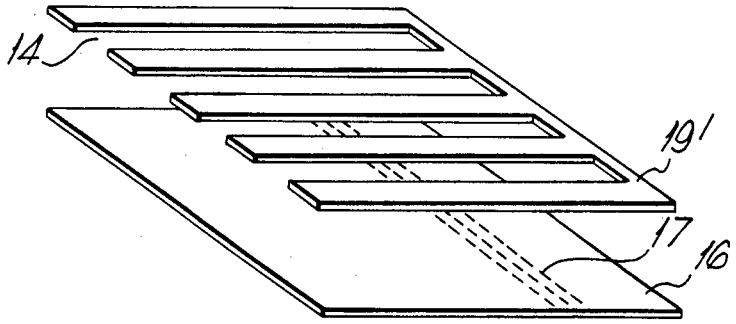
Figure 17:
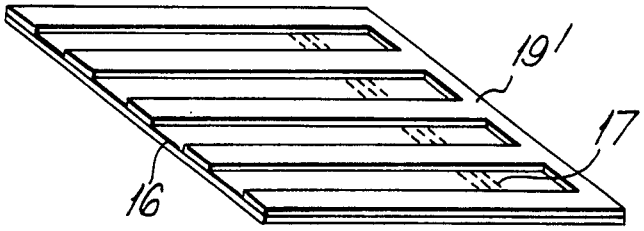
Figure 18:
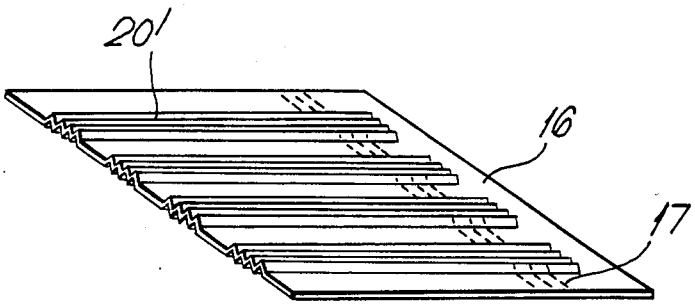
Figure 19:
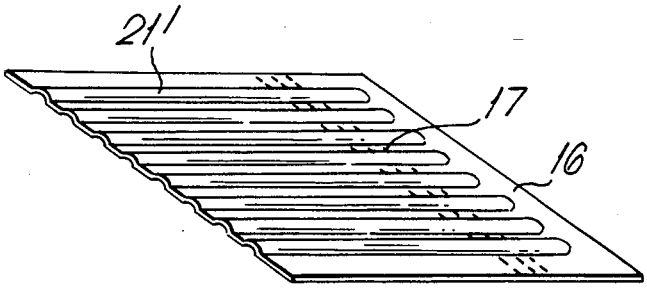
Figure 20:
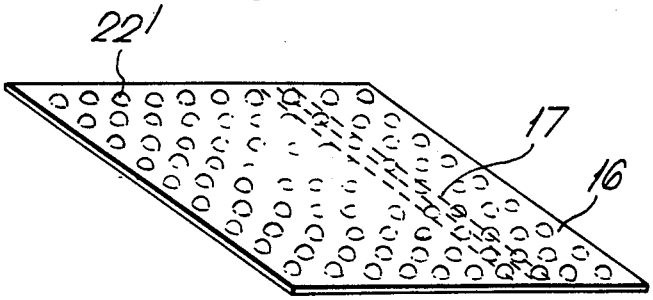
Figure 21:
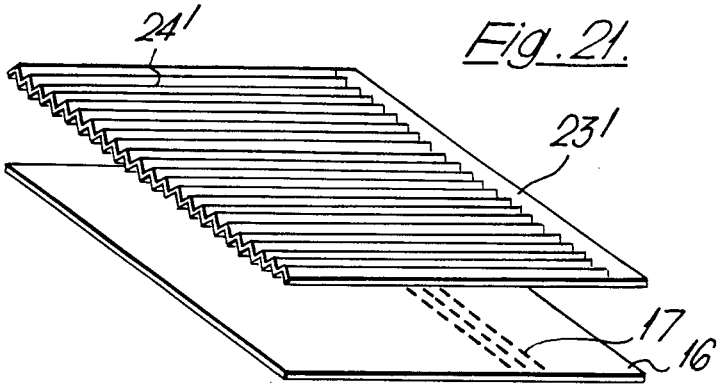
Figure 22:
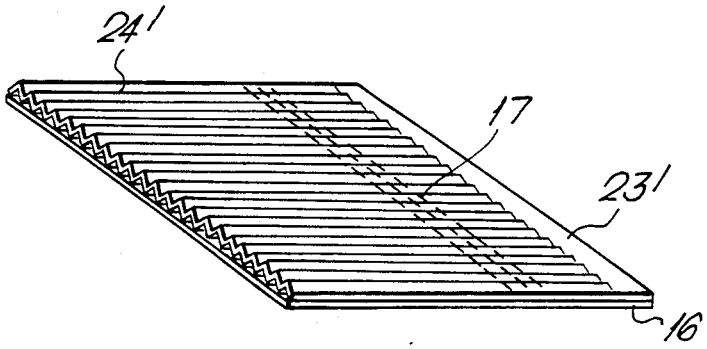
Figure 23:
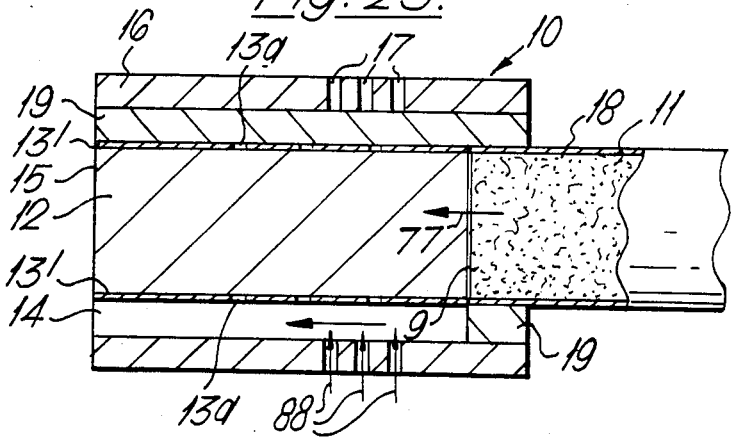
Figure 28:
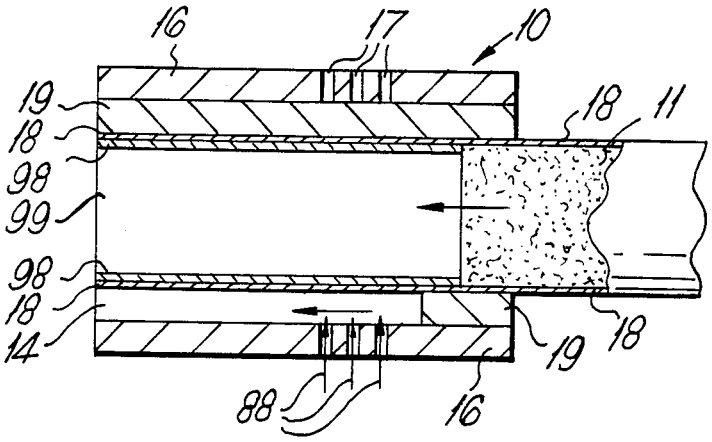
Figure 29:
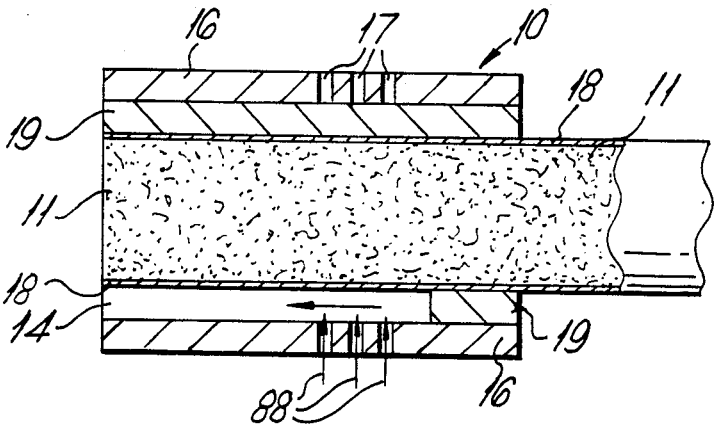

FIG. 13 is the view of FIG. 12 showing the tipping wrapper laminated to the crimped spacing means, FIG. 14 is a longitudinal cross-section through a fifth embodiment of the invention, and including an attached tobacco rod, FIG. 15 is a longitudinal cross-section through a sixth embodiment of the invention, and including an attached tobacco rod, FIG. 16 is a perspective view of a fifth embodiment of spacing means, and tipping wrapper, similar to that of FIG. 7, FIG. 17 is the view of FIG. 16 showing the tipping wrapper laminated to the spacing means, FIGS. 18–20 are perspective views of sixth, seventh and eighth respective embodiments of spacing means provided by modified tipping wrappers, similar to those of FIGS. 9–11, FIG. 21 is a perspective view of an alternative crimped spacing means, and a tipping wrapper, FIG. 22 is the view of FIG. 21 showing the tipping wrapper laminated to the crimped spacing means, FIG. 23 is a longitudinal cross-section through a seventh embodiment of the invention, and including an attached tobacco rod, FIGS. 24–27 are graphs showing the relationships between flows and pressure drops in relation to the channels and the tipping wrapper, FIG. 28 is a longitudinal cross-section of a hollow tipping assembly including an attached tobacco rod, and FIG. 29 is a longitudinal cross-section of a tipping assembly enclosing one end of a tobacco rod.

With reference to the above listing of the Figures and henceforth in the description, "longitudinal" will be understood to mean that axis of the filter plug and tobacco rod extending from the mouth end of the filter plug to the coal end of the tobacco rod, and "transverse" will be understood to mean at right angles to the longitudinal axis. "Longitudinal" does not imply that the channels are necessarily parallel to the axis of the plug: they may for example follow a helical path from one end of the plug to the other.

Referring now to FIGS. 1 and 5 there is shown a cylindrical tipping assembly 10 attached (as shown in FIG. 5) to a tobacco rod 11. The tipping assembly 10 comprises a smooth surfaced cylindrical filter plug 12 of cellulose acetate tow in abutment at one end with the tobacco rod 11. The cylindrical surface of the plug 12 is surrounded by a tubular plug wrapper 13 of paper and substantially impervious to air. This in turn is surrounded by a spacing wrapper 19 having four longitudinal and symmetrically spaced channels 14 cut in it extending from the mouth end 15 of the plug towards but not to the tobacco rod end of the plug. The tobacco rod 11 is enclosed in a paper wrapping 18. The spacing wrapper 19 is shown in flat configuration in FIG. 7. The spacing wrapper 19 is, apart from the channels 14, impervious to air and smoke. Surrounding the spacing wrapper 19 and in intimate contact therewith is a tipping wrapper 16 made of air-impervious paper but provided with perforations 17 at least some of which provide communication between the ambient atmosphere and the channels 14. The perforations may be arranged in three rows as shown or may take other configurations as required.

FIG. 8 shows the wrappers 16 and 19 laminated together in the configuration in which they will surround the filter plug 12. In a typical example there are 4 channels distributed symmetrically about the plug each channel being about 2 mm wide and of a length about three quarters that of the plug. The spacing wrapper will usually become glued to the plug wrapper in the cigarette making process.

Bearing in mind the impervious-to-air nature of the wrappers 13, 16 and 19, and the relative disposition of the perforations 17 and channels 14 it will be seen that when a smoker takes a draw on the tobacco rod 11 when ignited, tobacco smoke only is drawn through the filter plug 12 in the direction of arrows 77, and ambient ventilating air is drawn through the perforations 17 into the channels 14 in the direction of arrows 88. The indrawn ventilating air therefore reaches the mouth end without entering the filter plug 12. If the tobacco rod wrapping 18 is perforated or otherwise permeable to air there may be a further quantity of diluting air entering the smoker's mouth that has been drawn through the filter plug together with the tobacco smoke. The effects of ventilation and channel dimensions on pressure drops and smoke deliveries will be discussed in further detail hereinafter.

Referring now to FIGS. 9–11 it is shown how the tipping wrapper 16 may be modified to provide channels and spacing means between itself and the plug wrapper 13, thereby avoiding the need for a separate spacing wrapper 19.

In FIG. 9 the tipping wrapper 16 is provided with longitudinal raised crimped portions 20 extending from the mouth end of the wrapper past the perforations 17 towards but not up to the tobacco rod end of the wrapper. Likewise, in FIG. 10 the wrapper 16 is provided with longitudinal raised flutes 21 positioned in the same manner as the crimped portions 20. The embodiment of FIG. 11 shows raised dimples 22 replacing the crimped portions and flutes in the same manner. The crimped portions 20, flutes 21 and dimples 22 all act to space the tipping wrapper 16 from the plug wrapper 13 and simultaneously provide channels leading from the perforations 17 to the mouth end. In use the raised portions of the tipping wrapper will of course face inwards towards the filter plug.

FIG. 12 shows a further embodiment of the spacing means between the tipping wrapper and the plug wrapper comprising a spacing wrapper 23 provided with longitudinal corrugations or crimps 24 extending from the mouth end towards but not to the tobacco end. FIG. 13 shows the spacing wrapper 23 laminated to the tipping wrapper 16, the crimps extending over the perforations 17. FIG. 2 is a transverse cross-section through a tipping assembly showing the lamination of FIG. 13 wrapped round the impervious plug wrapper 13 of a filter plug 12 to provide channels 14.

Referring to FIGS. 3 and 6 there is shown a tipping assembly similar to that described with reference to FIGS. 1 and 5, corresponding features being given the same reference numerals, except that instead of plug wrapper 13 it is now provided with a ventilated plug wrapper 131 having ventilating perforations 13*a*. Ventilating air is thus enabled to enter the filter plug from channels 14 through perforations 13*a*. The modified tipping wrappers 16 of FIGS. 9–11 may be used with a ventilated plug wrapper.

FIG. 4 is a transverse cross-section through a tipping assembly showing the lamination of FIG. 13 wrapped round the ventilated plug wrapper 131 of FIGS. 3 and 6 to provide channels 14.

FIG. 14 is a longitudinal section through a tipping assembly of a further embodiment of the invention similar to that described with respect to FIG. 5 except that the channels 14 extend to overlap the tobacco rod 11. A small amount of tobacco smoke (89) may thus pass from the tobacco rod 11 into the channels 14 if the tobacco wrapping paper is sufficiently pervious or otherwise ventilated at the overlap. This gives the manufacturer the opportunity to exercise further control over the quality and quantity of gaseous and particulate products reaching the smoker's mouth, if so desired. It will be apparent that the transverse cross-section of FIG. 1 is equally applicable to FIG. 14 as it is to FIG. 5.

Referring to FIG. 5 there is shown a further embodiment of the invention similar to that described with respect to FIG. 6, including a ventilated plug wrapper 131 having ventilating perforations 13*a*, except that the channels 14 now extend to overlap the tobacco rod 11 as in FIG. 14. Here, likewise, if the tobacco wrapper paper is sufficiently pervious or otherwise ventilated at the overlap, the manufacturer has the opportunity to exercise further control over the quality and quantity of gaseous and particulate products reaching the smoker's mouth.

A spacing wrapper 191 with extended channels 14 suitable for use in above mentioned embodiments in which the channels overlap the tobacco is shown in FIG. 16 in flat configuration and separate from the tipping wrapper 16 which, as in previous embodiments, is provided with rows of perforations 17.

FIG. 17 shows the wrapper 191 and 16 laminated together in the configuration in which they will surround the filter plug 12.

Referring to FIGS. 18–20 it is shown how the tipping wrapper 16 may be modified to provide channels and spacing means between itself and the plug wrapper 13, the channels extending to overlap the tobacco rod, thereby avoiding the need for a separate spacing wrapper 191.

In FIG. 18 the tipping wrapper 16 is shown provided with longitudinal raised crimped portions 201 extending from the mouth end of the wrapper past the perforations 17 to and overlapping the tobacco rod end of the wrapper.

Likewise, in FIG. 19 the wrapper 16 is provided with longitudinal raised flutes 211 positioned in the same manner as the crimped portions 201.

The embodiment of FIG. 20 shows raised dimples 221 replacing the crimped portions 201 and flutes 211 in the same manner as in FIGS. 9–11. The crimped portions 201, flutes 211 and dimples 221 all act to space the tipping wrapper from the plug wrapper 13 and simultaneously provide channels leading from the perforations to the mouth end. In use, the raised portions of the tipping wrapper will of course face inwards towards the filter plug.

FIG. 21 shows a spacing wrapper 231 provided with longitudinal corrugations 241 extending from the mouth end to and overlapping the tobacco rod.

FIG. 22 shows the spacing wrapper 231 laminated to the tipping wrapper 16, the corrugations 241 extending over the perforations 17.

FIG. 23 shows a further embodiment of the invention in which a cylindrical filter assembly 10 is attached to a tobacco rod 11 enclosed in wrapping paper 18. The filter assembly has a ventilated plug wrapper 131 and channelled spacing wrapper 19 as in FIG. 6 except that the longitudinal channels 14 in the spacing wrapper 19 are coterminous with the interface 9 between the filter plug 12 and the tobacco rod 11. This may enable a small proportion of smoke from the tobacco rod to leak from the interface 9 into the channels 14 if so desired.

FIG. 28 shows an application of the invention to a papirossi cigarette. Here the mouthpiece of the papirossi cigarette is defined by a cardboard tube 98 abutting the end of the tobacco rod and enclosed in the cigarette paper wrapping 18 which also encloses the tobacco rod. The mouthpiece is enclosed by a tipping assembly 10 comprising a tipping wrapper 16 provided with ventilation holes 17 and a spacing wrapper 19 laminated to the tipping wrapper and lying between the tipping wrapper and the cylindrical surface of the papirossi mouthpiece. The spacing wrapper 19 is slotted as shown in FIG. 7 to provide longitudinal channels 14 between the tipping wrapper and the papirossi mouthpiece, the ventilating holes communicating with the channels 14. Hence, ventilating air may be drawn into channels 14 as shown by arrows 88 whilst smoke from the tobacco is drawn into the hollow part 99 of the tube, as shown by arrow 77. Smoke and ventilating air are thus kept distinct.

FIG. 29 shows an application of the invention to a cigarette in a similar fashion to that of FIG. 5 save that the plug 12 and its wrapper 13 of FIG. 5 is replaced by tobacco 11. The tobacco rod thus extends the whole length of the cigarette. The smoker can thus draw in ventilating air independently of the tobacco smoke.

It will be understood that the embodiments of the invention described above in conjunction with tobacco rods are purely diagrammatic and are intended to demonstrate the principles of the invention. In practice, a manufacturer may wish to take steps to avoid an unsightly lip between the tipping assembly and the remainder of the smoking article. One way of doing this is to reduce the diameter of the plug compared with that illustrated. Another way, perhaps in conjunction with the first way, is to bring the tipping wrapper 19 into contact with the cigarette paper wrapping 18 by overlapping. Other methods will occur to the man skilled in the art.

The following examples illustrate the relationships between flow and pressure drop across the channels for different dimensions of channels, the effect of permeability of the plug wrapper on ventilation, and the effect of ventilation on smoke delivery.

Let

Pt=pressure drop of tobacco rod

Pf=pressure drop of filter plug

Pp=pressure drop of perforations

Pc=pressure drop of channels

In the case of a ventilated cigarette made with channels as shown for instance in FIGS. 1 and 5, and with an impermeable plug wrapper $$Pt+Pf=Pp+Pc$$

Also, if permeability of the cigarette paper is low, $$Pt+Pf=K\times F$$

where K is a constant dependent upon the flow resistance of the tobacco rod and filter plug and F is total smoke flow through tobacco rod and filter plug.

The pressure drops Pp and Pc are in series and can therefore be measured separately and summed to give the total pressure drop across the ventilation system.

Pp will be related to the size and number of perforations in the perforation band on the tipping wrapper open to flow into the channels.

Pc will be related to the length, width and depth of the channels. It will also be dependent upon the number of channels, but for the examples we shall consider 4 per filter, distributed symmetrically around the filter plug. This is as shown in FIGS. 1 and 5, for example.

The pressure drop of the cigarette is mainly controlled by the requirements of smoke delivery, e.g. a high filter efficiency to produce a low delivery cigarette will result in a high pressure drop filter plug. Also, subjective smoking response will impose upper pressure-drop levels. A king size cigarette with no ventilation system will have a pressure drop range of 25–200 mm $H_2O$ with 17.5 $cm^3s^{-1}$ flow through the tobacco rod, and, with a filter system, will have a pressure drop range of 80–200 mm $H_2O$ for the same flow.

A prediction of the ventilation level on a cigarette can be made once data relating Pc and Pp to the ventilating air-flow have been obtained for a range of channel dimensions and tipping wrapper perforations.

In the examples the perforations in the tipping wrapper are each of nominal dimensions 0.4 mm×0.4 mm, the spacing between the adjacent perforations in a row being 1 mm centre to centre. Table 1 shows the air permeability in $cm^3$/min/cm perforation band/cm $H_2O$ for various numbers of rows of perforations in the tipping wrapper.

TABLE 1

| No. of rows of perforations | 1 | 2 | 5 |
|---|---|---|---|
| Air permeability | 340 | 618 | 1500 |

Examples 1–6 show how the pressure drop across the channels is controlled by the channel dimensions. The tests in these examples were carried out on a spacing wrapper laminated to a tipping wrapper as shown in FIG. 8, in its flat configuration, i.e. not wrapped round a filter plug. For design purposes the data so obtained are applicable with appropriate modification to a channelled spacing wrapper wrapped round a filter plug.

EXAMPLE 1

The pressure drop (P.D.) in mm $H_2O$ in a 4-channel ventilation system was measured for different flow rates in $cm^3$/sec for channels 0.16 mm deep, 2.5 mm wide, and of different lengths. The results are shown in Table 2.

TABLE 2

| Length | | | | | | | |
|---|---|---|---|---|---|---|---|
| 10 mm | | 12 mm | | 15 mm | | 18 mm | |
| Flow Rate | P.D. | Flow Rate | P.D. | Flow Rate | P.D. | Flow Rate | P.D. |
| 16.99 | 50.5 | 16.8 | 70.0 | 16.9 | 80.3 | 16.7 | 87.3 |
| 13.37 | 38.5 | 13.2 | 53.8 | 13.4 | 62.4 | 13.2 | 67.7 |
| 10.07 | 28.2 | 10.0 | 40.0 | 10.1 | 46.1 | 10.1 | 51.2 |
| 6.72 | 18.3 | 6.6 | 25.5 | 6.6 | 29.7 | 6.6 | 32.8 |
| 3.52 | 9.2 | 3.5 | 13.5 | 3.4 | 15.0 | 3.3 | 16.2 |

EXAMPLE 2

The pressure drop (P.D.) in mm $H_2O$ in a 4-channel ventilation system was measured for different flow rates in $cm^3$/sec for channels 0.16 mm deep, 2 mm wide and of lengths 15 mm and 18 mm. The results are shown in Table 3.

TABLE 3

| Length | | | |
|---|---|---|---|
| 15 mm | | 18 mm | |
| Flow Rate | P.D. | Flow Rate | P.D. |
| 17.1 | 118.5 | 17.0 | 141.9 |
| 13.6 | 91.2 | 13.3 | 108.3 |
| 10.2 | 66.0 | 10.2 | 81.3 |
| 6.8 | 42.3 | 6.6 | 50.7 |
| 3.5 | 20.7 | 3.4 | 26.1 |

EXAMPLE 3

The pressure drop (P.D.) in mm $H_2O$ in a 4-channel ventilation system was measured for different flow rates in $cm^3$/sec for channels 0.16 mm deep, 1.5 mm wide, and 15 mm long. The results are shown in Table 4.

TABLE 4

| Flow Rate | P.D. |
|---|---|
| 16.9 | 160.5 |
| 13.3 | 123.2 |
| 10.0 | 91.5 |

TABLE 4-continued

| Flow Rate | P.D. |
|---|---|
| 6.7 | 60.0 |
| 3.5 | 30.6 |

EXAMPLE 4

The pressure drop (P.D.) in mm $H_2O$ in a 4-channel ventilation system was measured for different flow rates in $cm^3$/sec for channels 0.32 mm deep, 2 mm wide, and 18 mm long. The results are shown in Table 5.

TABLE 5

| Flow Rate | P.D. |
|---|---|
| 16.6 | 33.0 |
| 13.1 | 25.0 |
| 10.0 | 18.4 |
| 6.6 | 11.7 |
| 3.6 | 6.2 |

EXAMPLE 5

The pressure drop (P.D.) in mm $H_2$) in a 4-channel ventilation system was measured for different flow rates in $cm^3$/sec for channels 0.092 mm deep, 2 mm wide, and 18 mm long. The results are shown in Table 6.

TABLE 6

| Flow Rate | P.D. |
|---|---|
| 17.0 | 329.0 |
| 13.4 | 265.0 |
| 10.2 | 202.0 |
| 6.9 | 138.0 |
| 3.6 | 72.0 |

EXAMPLE 6

The pressure drop (P.D.) in mm $H_2O$ in a 4-channel ventilation system was measured for different flow rates in $cm^3$/sec for channels 0.14 mm deep, 2 mm wide, and lengths of 10 mm and 18 mm. The results are shown in Table 7.

TABLE 7

| Length | | | |
|---|---|---|---|
| 10 mm | | 18 mm | |
| Flow Rate | P.D. | Flow Rate | P.D. |
| 16.9 | 137.7 | 17.0 | 185.7 |
| 13.6 | 108.9 | 13.5 | 145.8 |
| 10.0 | 78.9 | 10.2 | 109.5 |
| 6.8 | 52.5 | 6.9 | 74.1 |
| 3.5 | 26.7 | 3.5 | 37.5 |

Figure 24:
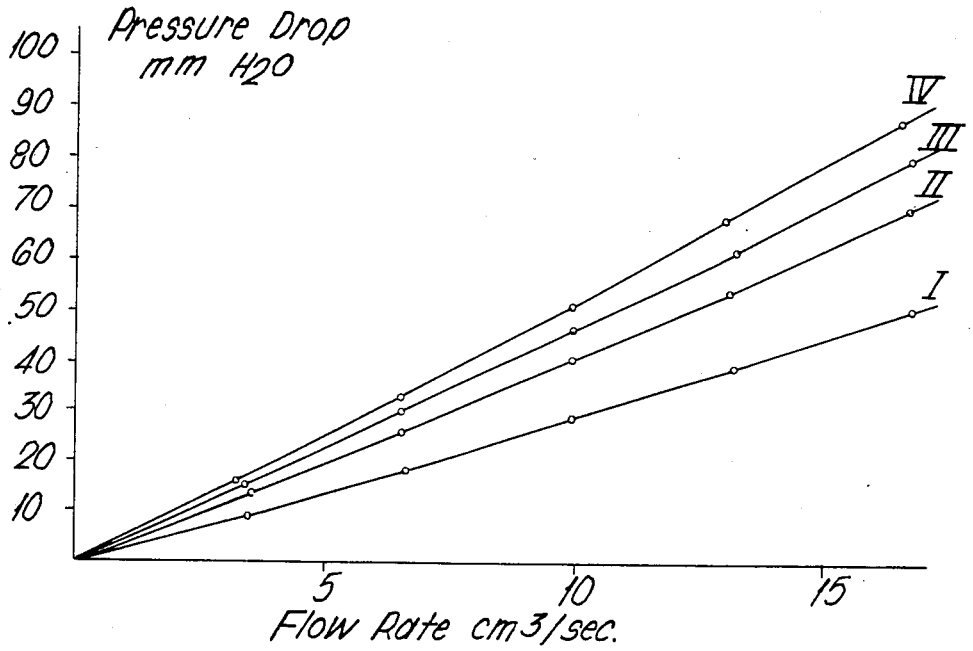
Figure 25:
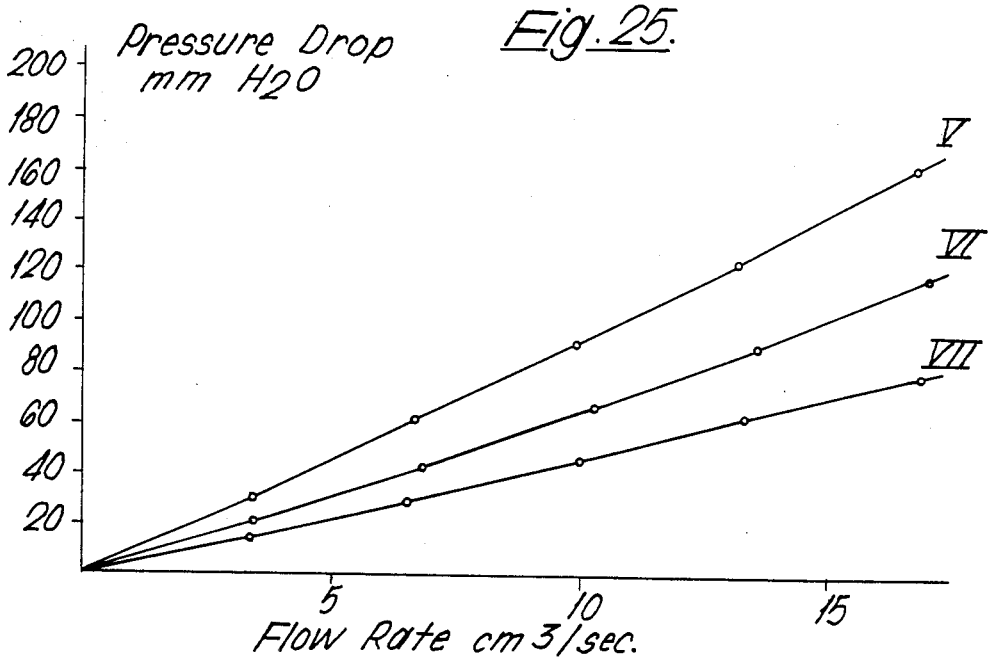
Figure 26:
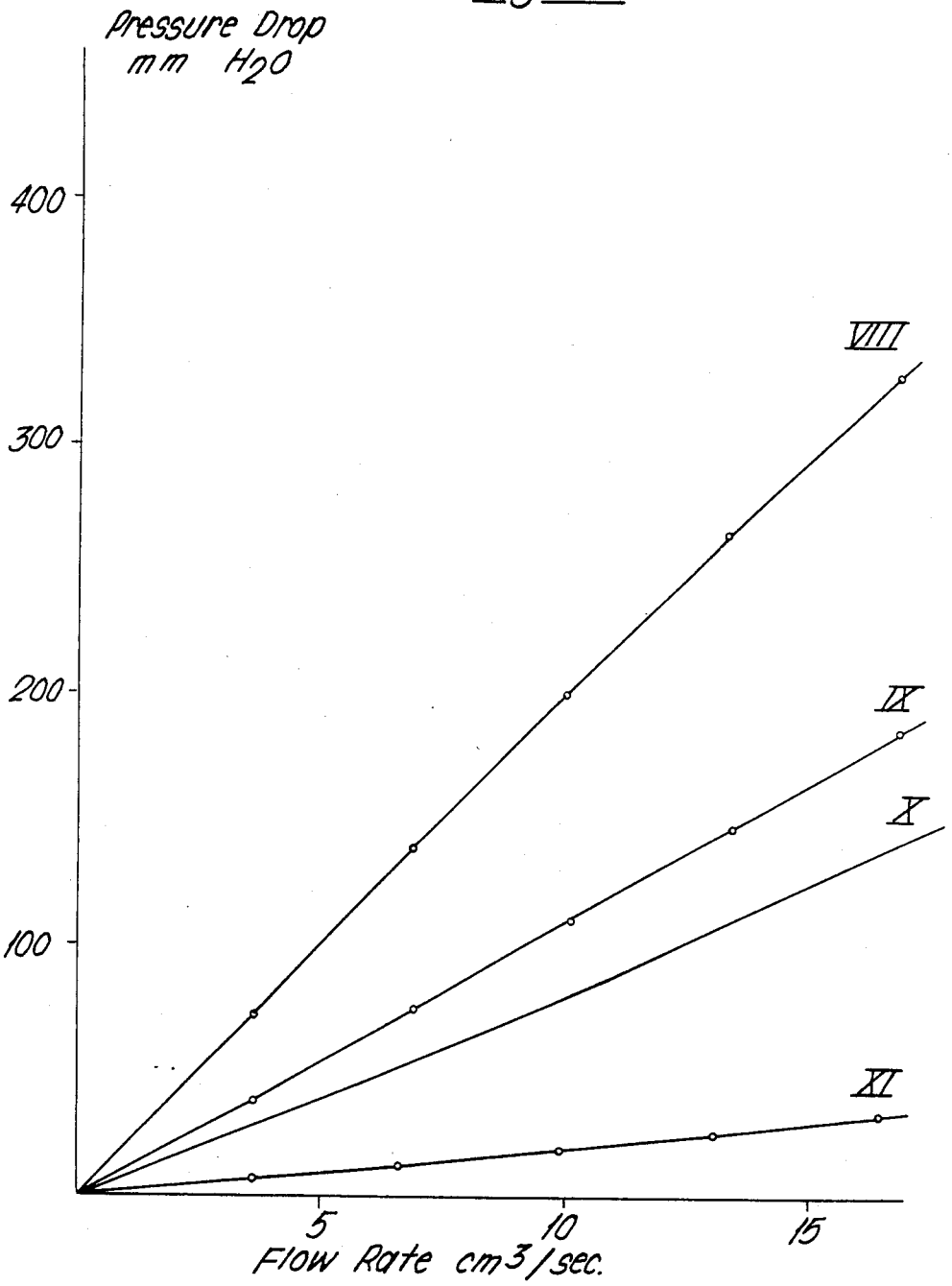
Figure 27:
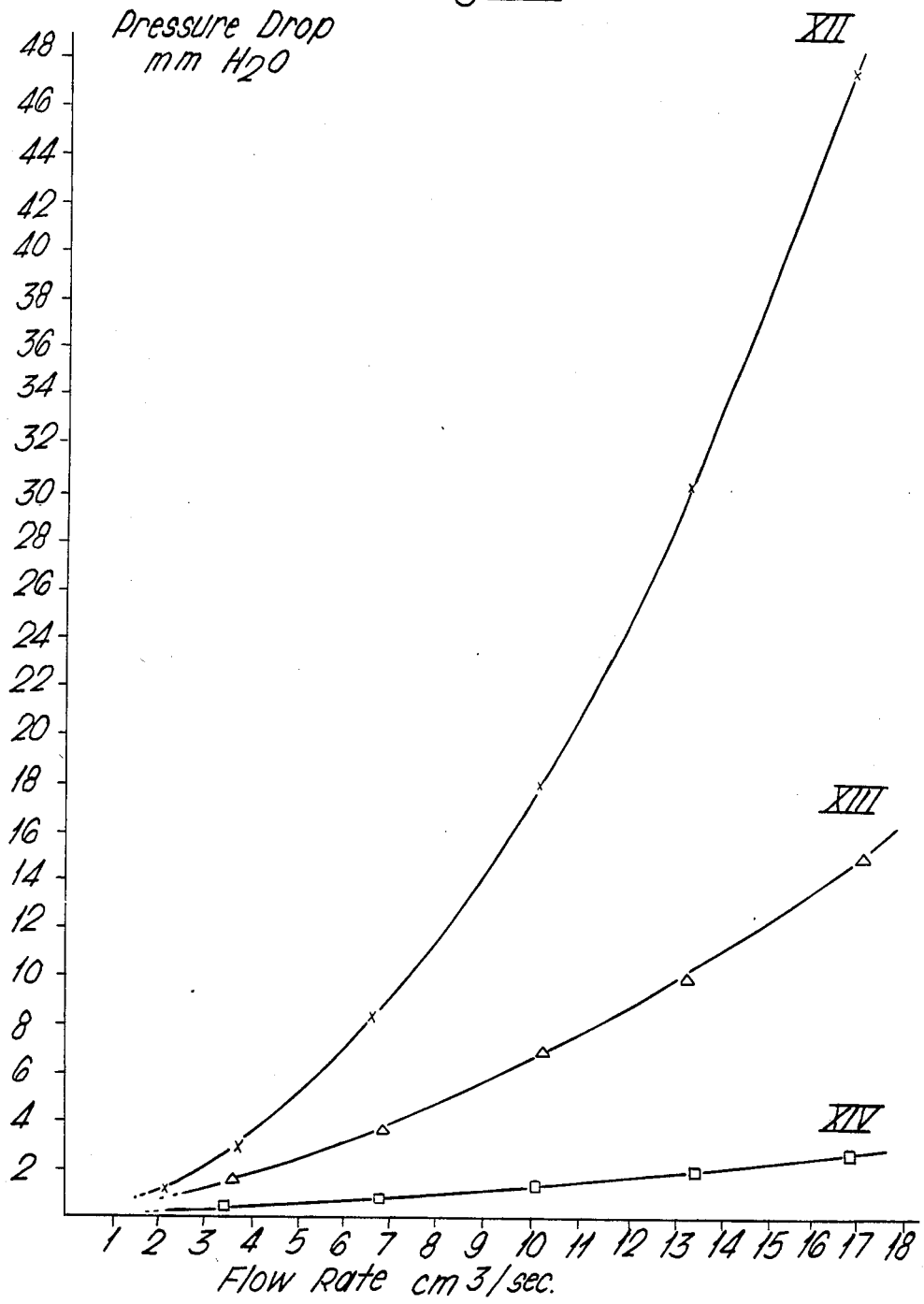

The results of examples 1–6 are shown as graphs in FIGS. 24, 25 and 26.

FIG. 24 shows the results of Example 1, that is, the relationship between flow and pressure drop at constant channel width and depth for different lengths. The ventilation system is composed of 4 channels, 2.5 mm wide and 0.16 mm deep. In this Figure, line I represents a channel length of 10 mm, line II a length of 12 mm, line III a length of 15 mm and line IV a length of 18 mm. It will be observed that the relationship between flow rate and pressure drop is substantially linear over the measured range.

FIG. 25 shows the relationship between flow and pressure drop at constant channel depth and length for different widths. The ventilation system is composed of 4 channels, 0.16 mm deep and 15 mm long. In this Figure, line V represents a channel width of 1.5 mm, line VI a width of 2.0 mm, and line VII a width of 2.5 mm. It will be observed that the relationships are substantially linear.

EXAMPLE 7

Ventilated tipping wrappers masked to leave 4×2 mm wide strips (i.e. corresponding to 4-channel spacing wrapper with 2 mm wide channels) were tested for flow and pressure drop characteristics according to the number of rows of perforations. The results are shown in Table 8 and are graphically illustrated in FIG. 27 where line XII corresponds to 1 row of perforations, line XIII corresponds to 2 rows, and line XIV to 5 rows. Flow rate is in $cm^3$/sec and pressure drop (P.D.) is in mm $H_2O$.

TABLE 8

| 1 row perforations | | 2 rows perforations | | 5 rows perforations | |
|---|---|---|---|---|---|
| Flow Rate | P.D. | Flow Rate | P.D. | Flow Rate | P.D. |
| 3.7 | 2.8 | 3.6 | 1.4 | 3.3 | 0.3 |
| 6.6 | 8.0 | 6.8 | 3.6 | 6.7 | 0.6 |
| 10.2 | 17.7 | 10.2 | 6.6 | 10.0 | 1.0 |
| 13.6 | 30.0 | 13.4 | 9.6 | 13.5 | 1.7 |
| 17.2 | 47.0 | 17.2 | 14.7 | 16.8 | 2.3 |

Polynominal regression analysis of the results of Table 8 indicates a parabolic relationship between flow rate and pressure drop for a given number of rows of perforations. Thus, if PD is pressure drop and f is flow rate then for 1 row of perforations, $PD=(14.35f^2+24.69f)/100$ for 2 rows of perforations, $PD=(3.08f^2+31.72f)/100$ for 5 rows of perforations, $PD=(4.623f^2+60.9f)/1000$ Comparisons of Table 8 with Tables 2–7, or of FIG. 27 with FIGS. 24–26, indicates that the pressure drop through the ventilated tipping wrapper is very much less than that along the channels, so that even with the perforations and channels operating in series the controlling pressure drop is provided by that along the channel.

EXAMPLE 8

A number of king size cigarettes were made with ventilation assemblies according to the design of FIGS. 3 and 6, that is, with plug wrappers having air permeabilities varying from 60–100 $cm^3/min/cm^2/cm\ H_2O$, and compared with an otherwise identical king size cigarette having an impermeable plug wrapper, that is, having a nominal permeability of 1 $cm^3/min/cm^2/cm\ H_2O$. The ventilation levels of these cigarettes were measured and shown in Table 9.

TABLE 9

| Nominal air permeability $cm^3/min/cm^2/cm\ H_2O$ | Ventilation level (%) |
|---|---|
| 1 (impermeable) | 58 |
| 60 | 59 |
| 100 | 60 |
| 200 | 62 |

These results show that the design of the ventilation system can be specified so that cigarettes made with plug wraps cover a large range of air permeabilities, the change in level of ventilation being insignificant over the range. It follows that an impermeable plug wrapper is not essential to the invention, and that permeable plug wrappers may be used by the manufacturer if he wishes to exercise a fine degree of control over the ventilation in special circumstances.

Tests were carried out to determine the effects of tipping paper permeability and channel dimensions on smoke delivery. The tests were done on three king size cigarettes made to an identical specification apart from pressure drop of the filter plug and ventilation channel dimensions. The results are shown in Tables 10–12 as follows:

TABLE 10

| | | | | |
|---|---|---|---|---|
| Cigarette type 1 | | | | |
| Ventilation channels (4): | length | 12 mm | | |
| | depth | 0.21 mm | | |
| | width | 2 mm | | |
| Pressure drop of filter plug: | | 180 mm $H_2O$ | | |
| Number of rows of perforations in tipping wrapper | 0 | 1 | 2 | 5 |
| Filter ventilation % | 0 | 65 | 67 | 75 |
| Puff number | 8.5 | 10.4 | 10.2 | 10.4 |
| Smoke nicotine mg | 1.05 | 0.32 | 0.25 | 0.13 |
| Particulate material (water, nicotine free) mg | 10.2 | 1.9 | 0.7 | 0.1 |

TABLE 11

| | | | | |
|---|---|---|---|---|
| Cigarette type 2 | | | | |
| Ventilation channels (4): | as for cigarette type 1 | | | |
| Pressure drop of filter plug: | 90 mm $H_2O$ | | | |
| Number of rows of perforations in tipping wrapper | 0 | 1 | 2 | 5 |
| Filter ventilation % | 0 | 49 | 51 | 56 |
| Puff number | 8.3 | 9.1 | 9.2 | 9.7 |
| Smoke nicotine mg | 1.59 | 0.93 | 0.88 | 0.72 |
| Particulate material (water, nicotine free) mg | 14.3 | 6.8 | 6.5 | 3.8 |

TABLE 12

| | | | | |
|---|---|---|---|---|
| Cigarette type 3 | | | | |
| Ventilation channels (4): | length | 12 mm | | |
| | depth | 0.09 mm | | |
| | width | 1.5 mm | | |
| Pressure drop of filter plug: | | 140 mm $H_2O$ | | |
| Number of rows of perforations in tipping wrapper | 0 | 1 | 2 | 5 |
| Filter ventilation % | 0 | 28 | 28 | 30 |
| Puff number | 9.1 | 9.2 | 9.0 | 9.5 |
| Smoke nicotine mg | 1.28 | 0.87 | 0.85 | 0.87 |
| Particulate material (water, nicotine free) mg | 11.2 | 6.6 | 6.5 | 6.4 |

It is seen that smoke deliveries are reduced with increasing ventilation.

EXAMPLE 9

A non-filter class B tobacco cigarette 69 mm long and 25.4 mm circumference was provided with a tipping ventilation assembly according to the embodiment of FIG. 32. The ventilation system was provided by 4 channels 14, each 12 mm long, 2 mm wide and 0.21 mm deep, and with either 1 or 5 rows of perforations 17 leading into the channels 14. The permeability of the cigarette paper 18 was measured to be 10 $cc/min/cm^2/cm\ H_2O$ at 5 cm $H_2O$ pressure drop (permeabilities of plug wrapping paper are usually measured at 10 cm $H_2O$ pressure drop). The percentage ventilation (being the percentage of puff volume using a 35 ml puff) at a pressure drop of 58 mm $H_2O$ was found to be:

| 1 row of perforations | 5 rows of perforations |
|---|---|
| 30% | 41% |

Modifications may be made to the invention within the scope of the claims. The permeability of the plug wrapper may be controlled either by perforations (as illustrated in the drawings) or by varying the porosity even for "impervious" plug wrapping paper.

Likewise, a perforated tipping wrapper made of impervious paper may be replaced for ventilation purposes by a paper of a specified degree of porosity which may be overall or restricted to certain zones of the wrapper.

The number of channels, although exemplified as 4, may suitably lie in the range 3–6 and may be 8–20 mm long, 1–3 mm wide and 0.075–0.35 mm deep.

The spacing wrapper or the tipping wrapper may be of materials other than papers, such as cellulose acetate or other plastics material.

The filter plug, although normally made of cellulose acetate tow, may be made of other materials used for filter plugs, such as other cellulose derivatives, papers, or polyalkylenes such as polypropylene.

The smoking material used may be other than tobacco, such as reconstituted tobacco, tobacco substitute, or any combination therewith or with tobacco.

The smoking article may be other than a cigarette, such as a cigarillo or cigar. The embodiment of FIG. 31 may be applied also to cigarillos or cigars.

An advantage of the invention is that it overcomes the inconvenience of grooved filter plugs, which need to be modified in order to provide different smoking and ventilation characteristics for different smoking blends, by providing a smooth ungrooved cylindrical plug which is used without change for a variety of smoking and ventilation requirements, thus effecting important economies in the production of filter cigarettes.

A second important advantage of the invention is that the degree of air ventilation to suit a given type of tobacco or tobacco blend is altered economically and easily merely by changing the design of spacing wrapper used, for instance in the preferred embodiment of FIGS. 1, 5, 7 and 8 by varying the number, width, depth and length of channels and by varying the ventilation characteristics of the tipping wrapper. It will be apparent to the man skilled in the art that changing a roll of spacing wrapper/tipping wrapper lamination to effect ventilation changes in simpler and more economic than changing a filter plug.

A third advantage of the invention is the opprotunity for fine control of ventilation characteristics by controlling the dimensions of the channels, compared with the relatively coarse control afforded by plugs of complex construction. The manufacturer is thus given the opportunity by this invention of controlling in an efficient and economical manner the smoke flavour characteristics of the tobacco.

The invention further provides that non-filter cigarettes (e.g. the embodiments of FIGS. 31 and 32) may be ventilated with air that comes to the smoker's mouth independently of the tobacco smoke. This ventilation is controllable to suit individual tobacco characteristics by varying channels dimensions as described above or by providing a porous or otherwise ventilated cylindrical element.

We claim:

1. A tipping assembly for an elongate smoking article including a tobacco rod, the assembly comprising (a) a cylindrical smoke filter plug having a smooth ungrooved circumferential surface of circular cross-section abutting the tobacco rod, (b) a laminated tipping wrapper surrounding the plug, the inner lamination of the wrapper being adapted to define in cooperation with said circumferential surface of the plug air channels between the tipping wrapper and the plug extending to a mouth end of the assembly, (c) means for blocking off those ends of the channels distal to the mouth end of the assembly, the mouth end of the channels being open to the user, and (d) ventilating means in the tipping wrapper, whereby, in use, ventilating air is drawn through the ventilated tipping wrapper into the channels and thence into the smoker's mouth.

2. A tipping assembly as claimed in claim 1 wherein the inner lamination is provided with longitudinal slots to define, in cooperation with the plug, said air channels.

3. A tipping assembly as claimed in claim 1 wherein the inner lamination is provided with longitudinal grooves or corrugations, to define, in cooperation with the plug, the air channels.

4. A tipping assembly as claimed in claim 2 wherein the width of the slots lies in the range 1–3 mm and the depth of the slots lies in the range of 0.075–0.35 mm.

5. A tipping assembly as claimed in claim 1 wherein the ventilating means is provided by perforations in the tipping wrapper.

6. A tipping assembly as claimed in claim 1 wherein the ventilating means is provided by a zone of the tipping wrapper that is permeable to air.

7. A tipping assembly as claimed in claim 1 wherein the means for blocking off those ends of the channels distal to the mouth end of the assembly is provided by a portion of the tipping wrapper.

* * * * *